United States Patent [19]

Nugent et al.

[11] 4,448,050

[45] May 15, 1984

[54] LOCKS

[76] Inventors: Walter J. Nugent; Leslie G. Nugent, both of 147 Rae St., North Fitzroy, Melbourne, Australia, 3068

[21] Appl. No.: 237,133

[22] PCT Filed: Jun. 18, 1980

[86] PCT No.: PCT/AU80/00023

§ 371 Date: Feb. 20, 1981

§ 102(e) Date: Feb. 3, 1981

[87] PCT Pub. No.: WO80/02857

PCT Pub. Date: Dec. 24, 1980

[30] Foreign Application Priority Data

Jun. 20, 1979 [AU] Australia ..... PD9271

[51] Int. Cl.[3] ..... E05B 27/10; E05B 13/10; E05B 17/04; E05B 19/16

[52] U.S. Cl. ..... 70/223; 70/346; 70/347; 70/360; 70/363; 70/382; 70/411

[58] Field of Search ..... 70/223, 218, 149, 139, 70/134, 382, 380, 379, 351, 346, 231, 165, 363, 362, 349, 350, 356

[56] References Cited

U.S. PATENT DOCUMENTS

| | | | |
|---|---|---|---|
| 3,125 | 6/1843 | Voorhies | 70/350 |
| 474,519 | 5/1892 | Candee | 70/223 X |
| 757,265 | 4/1904 | Campbell | 70/345 |
| 817,713 | 4/1906 | Hope | 70/149 |
| 1,302,933 | 5/1919 | Langton | 70/223 X |
| 1,505,571 | 8/1924 | Luoma | 70/382 |
| 1,720,838 | 7/1929 | Iznaga | 70/346 X |
| 1,867,650 | 7/1932 | Bryan | 70/165 X |
| 2,238,942 | 4/1941 | Marateck | 70/363 |
| 2,919,739 | 1/1960 | Vocke | 70/231 X |
| 4,006,615 | 2/1977 | Szova | 70/363 |

FOREIGN PATENT DOCUMENTS

| | | | |
|---|---|---|---|
| 103935 | 5/1938 | Australia | 70/360 |
| 746946 | 3/1933 | France | 70/411 |
| 794791 | 12/1935 | France | 70/134 |
| 921676 | 1/1947 | France | 70/223 |
| 471742 | 5/1952 | Italy | 70/223 |
| 1541483 | 3/1979 | United Kingdom | 70/346 |

*Primary Examiner*—Cornelius J. Husar
*Assistant Examiner*—Carl F. Pietruszka
*Attorney, Agent, or Firm*—Holman & Stern

[57] ABSTRACT

A key operated lock having a handle member slidably and rotatably operating within a rose member secured in a door, the rose having a bore therethrough in which a lock cylinder is rotatably mounted but restrained against axial displacement and has an axially displaceable and rotatably mounted latch actuator operably engageable with the handle by a key insertable into the handle transversely to the rotational axis. The lock cylinder has fixed wards extending toward the handle and key member which in the proper position of the key are in alignment with holes in the key which permit interlocking of the handle via the key with the lock cylinder for simultaneous rotation. Push rods are axially movable in the lock cylinder and are displaced by the key through axial movement of the handle to displace the latch actuator into coupling engagement with the lock cylinder for rotation therewith and engagement with the latch release device for the door, so that rotation of the handle via the key will thereby release the latch.

17 Claims, 10 Drawing Figures

LOCKS

CROSS REFERENCE TO RELATED APPLICATION

The invention of this application is disclosed in prior co-pending International Application No. PCT/AU80/00023, filed June 18, 1980, the benefit of which is claimed.

BACKGROUND OF THE INVENTION

1. Field of the Invention

The present invention relates to locks and particularly to locks adapted for a wide variety of applications providing domestic door locks, high level security locks with or without cooperating timing devices, motor vehicles ignition locks and the like.

2. Description of the Prior Art

The state of the locksmiths art has reached a very high level of expertise, particularly in relation to mechanically operated locks. Recent developments in key copying machines have however considerably reduced the security of these locks, in view of the ease with which key copies, including master keys, may be made and the difficulty for the lock concerned to be altered to reject a key that has been duplicated without authority.

BRIEF SUMMARY OF THE INVENTION

Our invention overcomes this difficulty and has been developed without reference to locks of the prior art. Accordingly many features of our lock are entirely novel. Whilst a preferred embodiment of the lock will be described herein with reference to a domestic door lock, in its broadest form our invention comprises a lock including a locking member, said locking member being movable between a disengaged and an engaged position, said lock including movable push rod actuating means and substantially immovable wards, said movable means being operable to cause said locking member to move between said disengaged and engaged positions, a key means interengageable with said wards and said movable push rod means, said key operative to actuate said push rod means and thereby said locking member.

According to a further aspect of the invention the said locking member is biassed towards the said disengaged position.

According to a still further aspect of the invention there is provided a lock having movable push rods and substantially immovable rod-like wards arranged in a generally parallel and preferably coaxial relationship; means for accomodating a key including a token at a position adjacent one end of the rod-like element; and means for moving the thus accommodated token over the substantially immovable rod-like wards and against the movable push rods, thereby to move the push rods.

BRIEF DESCRIPTION OF THE DRAWINGS

A preferred embodiment of the invention will now be described with reference to the accompanying drawings wherein.

DESCRIPTION OF PREFERRED EMBODIMENT

Figure 1:
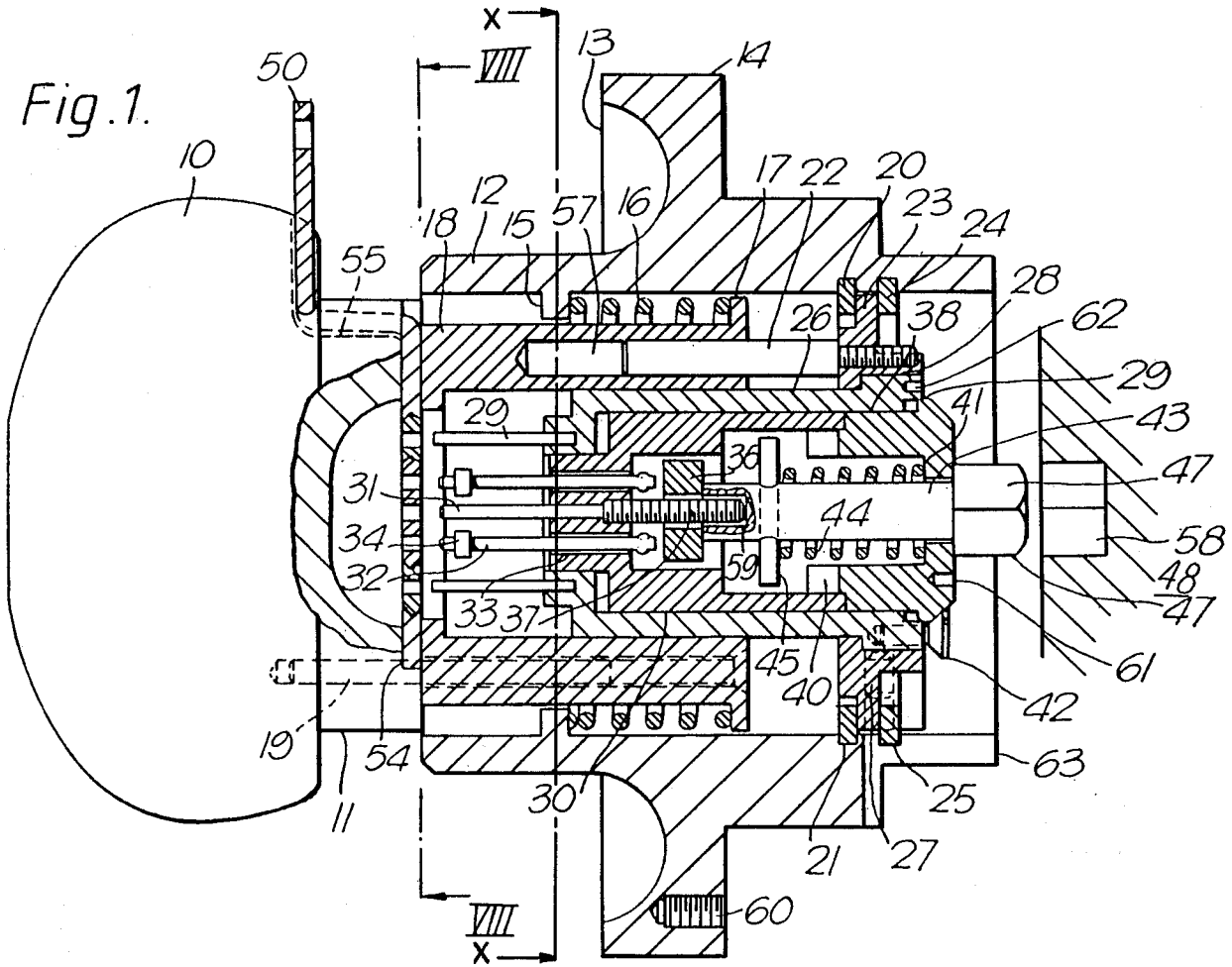
FIG. 1 is a cross-sectional view showing the lock of this invention in a locked (unengaged) configuration with the cylinders equidistant within the casings, rather than eccentric and the handle withdrawn.
Figure 2:
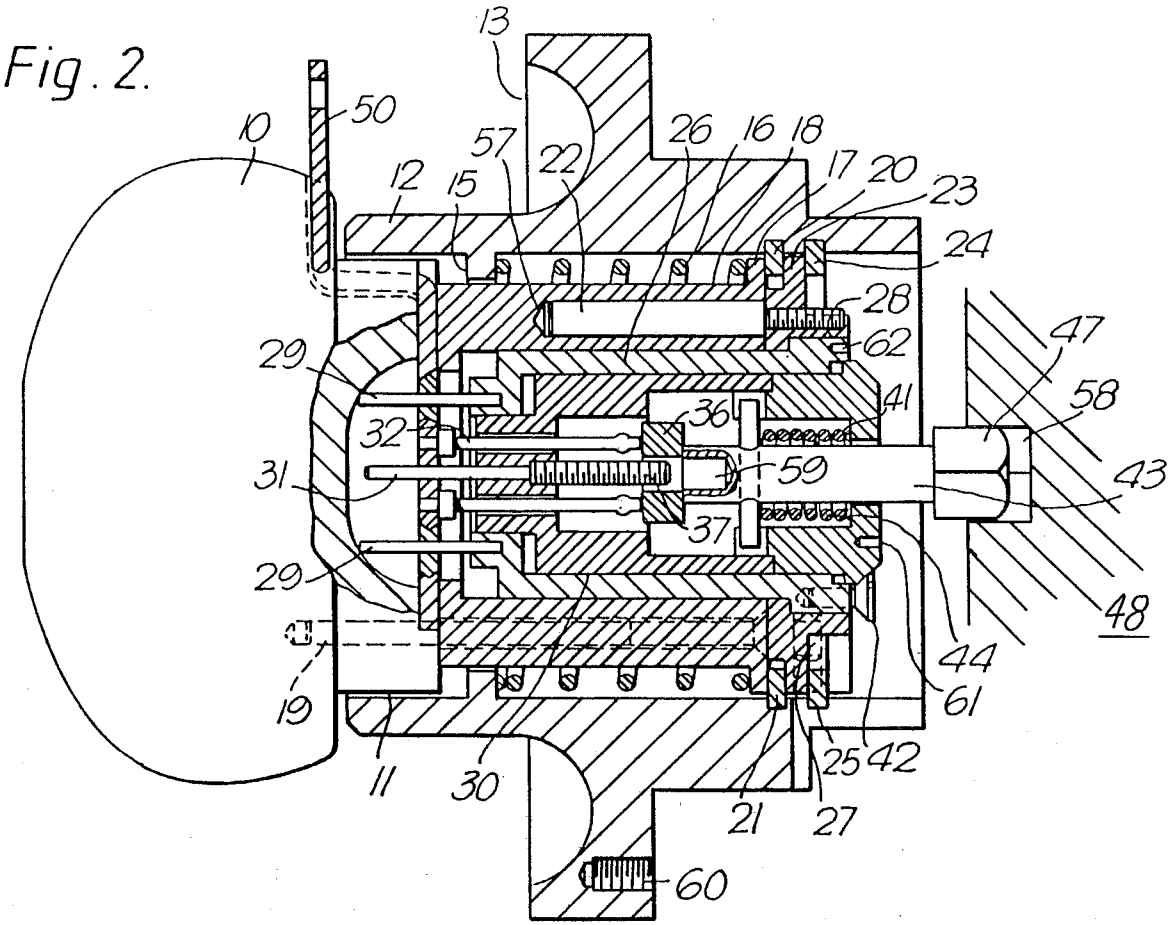
FIG. 2 is a cross-sectional view similar to FIG. 1 showing the lock in an unlocked (engaged) configuration.
Figure 3:
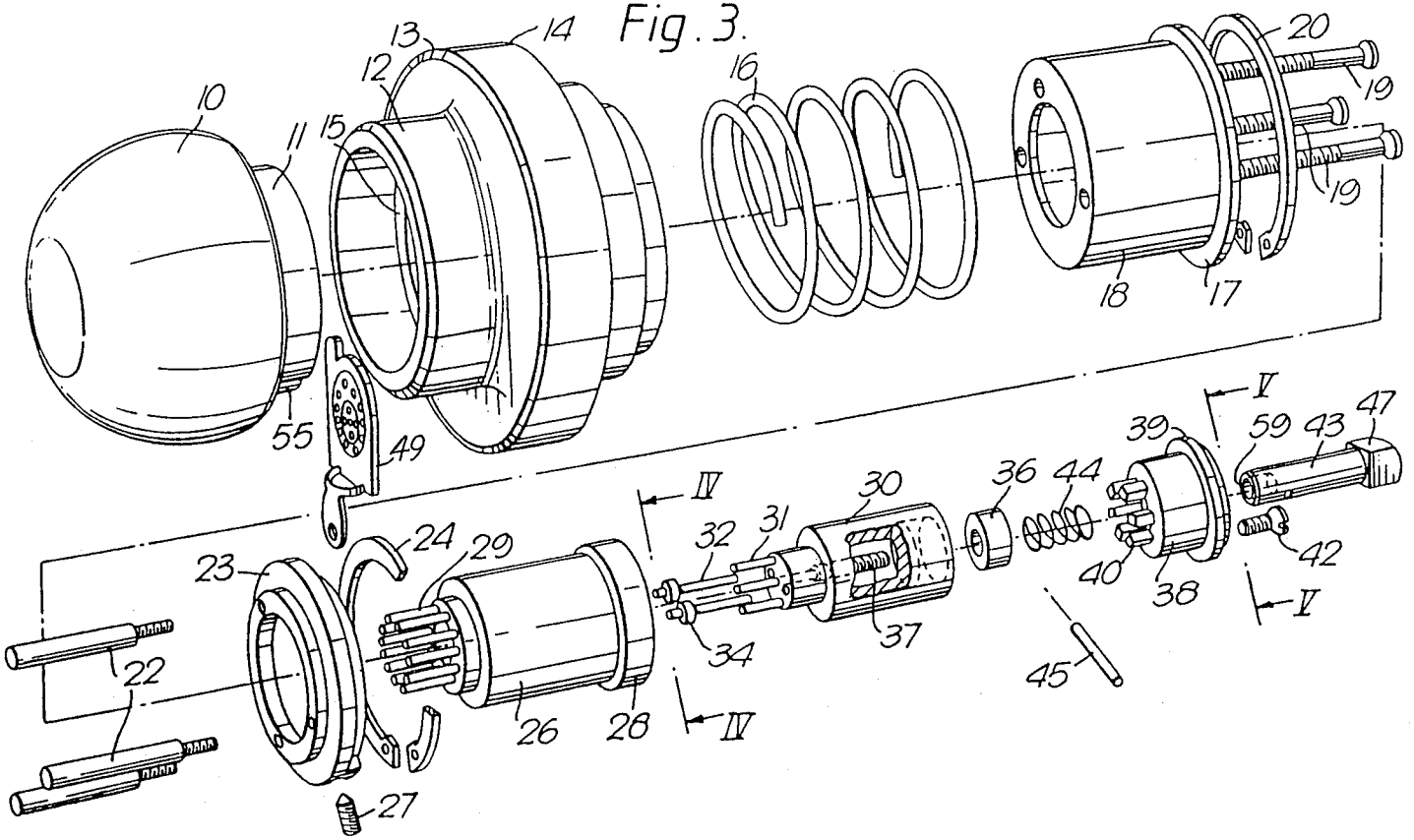
FIG. 3 is an exploded view of the lock of FIG. 1.

Referring to FIG. 1 and FIG. 3, there is provided a handle 10 having a cylindrical neck 11 adapted to be axially movable into and away from a collar 12 of a door rose 13. In use, the rose 13 is positioned within a suitable circular recess in a door (not shown) such that the shoulder 14 of the rose bears against the face of the door. FIGS. 1 and 2 clearly illustrate this, and emphasize a major advantage of this invention in that the lock mechanism is substantially within the door and not merely within the handle as is the case with the prior art. This of course adds to the security of the lock.

The rose 13 is secured to the door by means of bolts (not shown) passing through the door from the other side and engaging the rose in threaded recesses, one of which is shown at 60.

The collar 12 is provided with an internal flange 15 which comprises the upper limiting means for a main compression spring 16, the other end of which bears against a flange 17 of the lock casing 18. The lock casing is secured to the handle 10 by three bolts 19 and is biassed away from same by said spring 16.

The outer casing 18 is axially movable within said rose 13, and is constrained by a first circlip 20 engaged in an annular groove 21 in the lock casing best shown in FIG. 1 or 2.

The lock mechanism comprising the crux of this invention is housed within the casing 18 and is prevented from rotating therein by three rods 22 secured in an inner collar 23. The rods 22 allow axial movement of the lock mechanism by sliding within bores 57 provided in the casing 18 best shown in FIG. 1 or 2.

The inner collar 23 is secured within the collar 12 by a second circlip 24 engaged in a second annular groove 25 in the outer collar 12. Within the inner collar 23 is provided the lock cylinder 26, which is provided with a number of fixed rods 29 coaxial with the lock assembly. The lock cylinder is secured against rotation or axial movement within the inner collar by a set screw 27 which is tightened against a shoulder 28 of the cylinder. Hence the cylinder and inner collar 23 may rotate within the outer collar 12 but are restrained axially. The fixed rods 29 are preferably of equal length, and protrude to a level just inside the rim of the outer collar 12. These fixed rods act as wards and may vary in diameter, shape, number and location in the lock cylinder 26.

The inner collar/cylinder, outer casing and outer collar deliberately make a loose fit one within the other, although the components within cylinder 26 are fitted with decreased tolerances. The reason for the variation in tolerances will be explained more fully below.

An inner cylinder 30 having any desired combination of fixed rods 31 as wards and sliding rods 32 as push rods protruding therefrom is provided eccentrically within the upper portion of said outer cylinder 26, such that the said rods also protrude into the neck of the rose collar to a distance approximately the same as the wards 29 but eccentrically with respect to same. The push rods 32 are located within bores 33 and their upper ends are provided with shoulders 34. Removal of the push rods is also prevented by deformities in the lower ends of the rods as shown in FIG. 1 or 2. The locking member is provided within said inner cylinder 30, and in this embodiment comprises a bushing 36 loosely mounted on a rod 37.

Within the lower portion lock cylinder 26 is located an eccentrically bored clutching sleeve 38 having a shoulder 39 on the lower side thereof and castellations 40 on the upper face thereof. The sleeve is affixed to the inner cylinder 30 by any suitable means, such as silver solder or threaded engagement. It is obviously important that the sleeve be rotated with respect to the inner cylinder before it is affixed to same, in order that the same degree of eccentricity is achieved. This is desirable to ensure that the axis of the locking member is parallel to the axis of the lock. An internal flange 41 is provided on the inner sides of the sleeve 38, as seen in FIGS. 1 and 2. Said sleeve is secured against rotation or axial movement within the lock cylinder 26 by any suitable means such as a cup head bolt 42.

Within the sleeve is provided a connecting member 43 which is biassed over rod 37 toward locking member 36 by a compression spring 44 which in turn is restrained by a bar 45 through a hole near the inner end of the connecting member 43 and the flange 41.

The inner end of the connecting member is bored out at 59 to accomodate rod 37. The operative end of the connecting member 43 is shaped into a square rod at 47 to engage a square hole 58 in any known latch withdrawal mechanism shown generally at 48 in FIGS. 1 and 2. The hold in this sleeve 38 through which the locking member passes is eccentric in relation to the cylinder 26 by approximately 0.05 inches.

Figure 6:
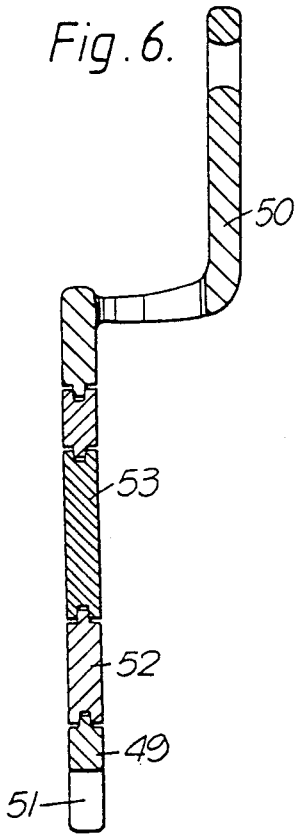
FIG. 6 is a cross-sectional view of the key.
Figure 7:
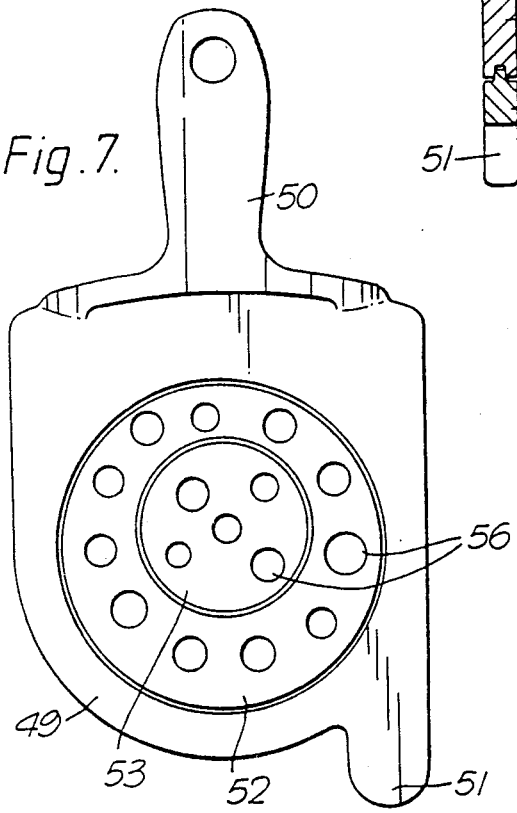
FIG. 7 is an elevational view of the key.
Figure 8:
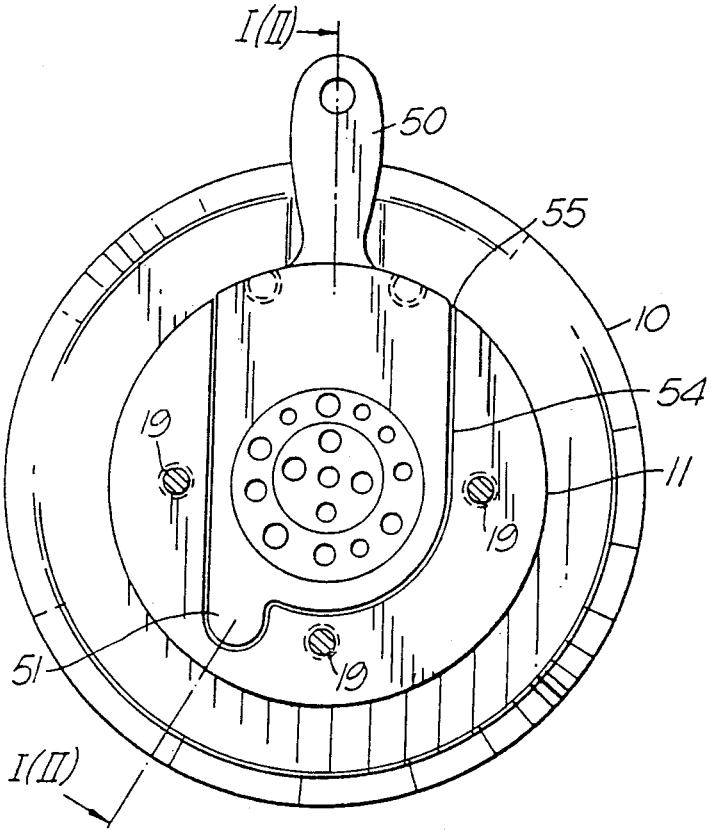
FIG. 8 is an inverted elevational view of the handle with the key in position.
Figure 10:
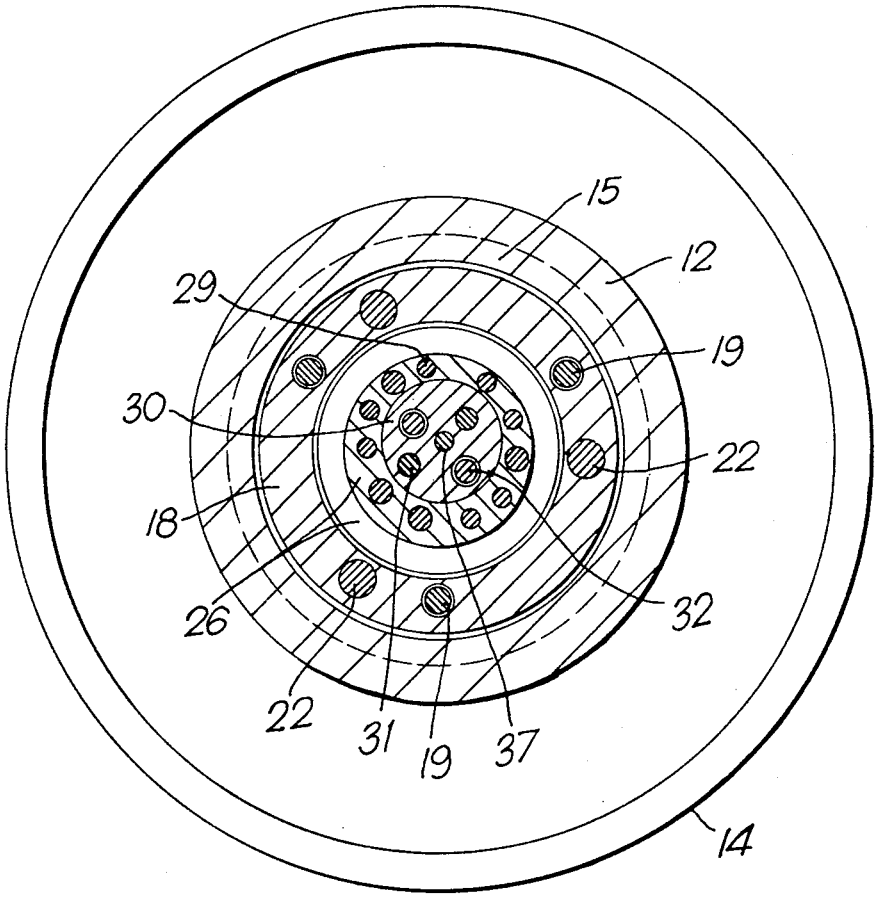
FIG. 10 is a cross-sectional view taken on the line X—X of FIG. 1.

The key as shown in FIGS. 6 and 7 comprises a flat frame 49 to which is attached a handle 50. The frame is made unidirectional by a tongue 51, and is provided with two rotatable tokens 52, 53 one within the other.

The placement of this inner token 53 is eccentric within the outer token 52 thereby providing a greater number of combinations and thus greater security. Each token is provided with holes 56, which may be varied in number size and location from key to key to suit the variations on the cylinders. In an unillustrated variation the key may be more acceptable to the consumer by the provision of a handle that folds into the same plane as the frame.

The inner face of the neck 11 of the handle 10 is provided with a shallow recess 54 for receiving the key when inserted into the handle in a radial direction. Further, the side of the neck 11 is recessed at 55 to accomodate the key handle 50 on release of the door handle 10 and axial movement of the key within the collar 12. This will now be fully described.

The following relates to the installation of the lock in an exterior door handle, and in most cases is matched with a normal direct acting handle on the inside of the door.

Normally, the handle will inoperatively turn without resistance, the connecting member being withdrawn within the cylinder by spring 44. Hence the handle is not linked to the known latch mechanism, and the door is "locked". The lock of our invention is in "neutral", or disengaged.

The handle is biassed towards the door by spring 16, but may be axially withdrawn so that a key may be radially inserted into recess 54 on the inner face of the handle neck 11. The key must be fully inserted to allow the legs of the handle to fit into recess 55.

Once the key is in position in the handle, the handle may be released, causing the key to be axially carried onto the rods 29, 31 and 32. The key is held by the base of the neck 11 on one side, recesses 54 and 55, and the upper end of the casing 18 on the other side. Thus such handle, outer casing and key axially and rotationally move together in relation to the collar 12.

The inward movement of the key and handle will continue only if the holes in the tokens match the rods with regard to number, spacing, size and shape. If the key does not fit, the handle will turn inoperatively. Rotation of the handle and key may be necessary befoe the key will come to the correct position and the rods penetrate the tokens. On further inward movement of the handle certain holes 56 of the key slide along the respective aligned wards, but the key at other holes depresses the two movable rods by bearing down on their shoulders 34. The push rods 32, which are diametrically opposed, slide the locking member 36 along rod 37 into engagement with connecting member 43. The connecting member thereby is pushed out of sleeve 38 against the bias of spring 44. At this stage rotation of the handle will not open the door, although the key is engaged with and may turn the cylinder.

Further release of the handle results in the bar 45 entering one of the slots formed by the castellation 40 of the connecting member and the entry of the operative end of the connecting member into the co-operative recess 58 in a known latch withdrawal mechanism. Obviously the configuration of the operative end 47 may be adapted to cooperate with the latch mechanism that is desired.

Once the handle is fully released rotation will cause the sleeve, and thus the bar and the connecting member to turn. Hence the door will open.

It is obviously essential that cup head bolt 42 be tight, ensuring no slippage between the sleeve and the cylinder. Other methods of securing these components form part of the invention, as does equivalent methods of securing the cylinder to the collar 23 other than by the set screw 27.

In the preferred form shown, two movable rods 32 are used. This provides protection against the unauthorized depression of one rod 31, as the bushing, which is a loose fit on rod 37, would then become misaligned due to the uneven pressure and lock on rod 37. Friction means such as the provision of thread on rod 37 may be used to enhance such locking action. The immobilization of the bushing thus prevents movement of the connecting member.

Figure 4:
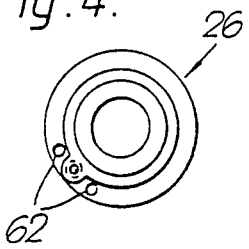
FIG. 4 is an end view taken on the line IV—IV of FIG. 3.
Figure 5:
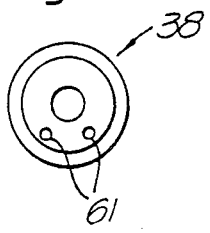
FIG. 5 is an end view taken on the line V—V of FIG. 3.
Figure 9:
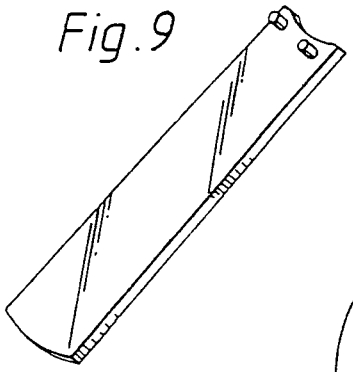
FIG. 9 is a perspective view of the adjustment tool.

A major advantage of our invention is found in the ability to reset the tokens within the key. Either one or both tokens may be reset. Should it be desired to rotate the inner token in relation to the outer token and the key frame, the key is inserted in the door in the normal way. The inner handle assembly (which is not subject to security measures) and the outer handle assembly are removed, exposing the inner face of the lock assembly. The cup head bolt 42 is loosened, and an adjustment tool (FIG. 9) is fitted to the holes 61 in the sleeve and the whole rotated as desired. See FIGS. 4 and 5. This action causes the pins 31, 32 to rotate with respect to pins 29, and hence the inner token relative to the outer in the key. The bolt 42 is then re-tightened.

To alter the outer token in relation to the key frame, the set screw 27 is loosened, and the tool applied to holes 62 in the outer cylinder 26. Rotation of the outer cylinder within the casing 18, which holds the key via the handle recess, achieves the desired result.

Hence a large number of positions may be achieved for one key/lock combination. Variations in the size, shape and position of the holes/rods provides an almost infinite number of combinations.

The ability to easily re-set the lock and its key is seen as one of the most important advantages of the invention. No master key system is thought to be applicable, thus further increasing security.

If desired, a second lock may be fitted to the inner handle, in which case the inner collar (not shown) of the rose of the second lock would be lengthened and expanded to project further through the door to engage and slide over the collar 63 of the first rose. In this case transverse holes are provided through the overlapping collars and long expanding bolts of the Luxon type used from the edge of the door to lock the two collars, and hence the two lock assemblies, together.

Where only the outer handle is fitted with a lock, the inner handle may be provided with a snib to prevent the locking member engaging. Thus even possession of a correct key would not guarantee entry if the inner handle were snibbed.

INDUSTRIAL APPLICABILITY

Whilst our invention has been described in relation to a domestic door lock as represented in the drawings, it is to be appreciated the lock mechanism may take on many forms bearing little physical resemblance to the door lock shown in the drawings. The invention has application ranging from simple domestic systems to the highest level of security control, for example in bank vault mechanisms and defense establishment uses.

Naturally, the higher the level of security required, increasing use may be made of preferred design features such as multiple cylinders, eccentricity of cylinders and tokens, multiple tokens, and the use of sophisticated means equivalent to the connecting member.

What is claimed is:

1. A key operated lock comprising, a body member having a bore therethrough adapted to be secured to a door or the like, a lock cylinder rotatably mounted in said bore of said body member, means to restrain said lock cylinder against axial movement relative to said body member, a latch actuating member adapted to be engageable with a latch release means, a handle member rotatably mounted on said body member and being axially movable relative to said bore, a substantially transverse opening in a side of said handle member, at least one ward member fixedly attached to said lock cylinder to be held against axial movement relative to said handle, releasable coupling means in said lock cylinder operable in the engaged position to connect said latch actuating member to said lock cylinder for rotation therewith, coupling actuating means movably mounted in said lock cylinder for movement from a rest position to an actuating position at which said coupling means is engaged and said latch actuating member is engaged with said latch release means, a key having a blade insertable into said transverse opening to be movable rotationally and axially with said handle, and at least one hole through said blade positoned with respect to said handle when operably inserted therein so that said ward member enters said hole by relative axial displacement of said handle to allow said key blade to engage said coupling actuating means to move it into said actuating position and said lock cylinder and latch actuating member to rotate in response to rotation of said handle to release said latch.

2. A lock as claimed in claim 1, wherein each said ward member is an elongate projection the longitudinal axis of which is substantially parallel to the rotational axis of said lock cylinder.

3. A lock as claimed in claim 1, wherein said handle comprises a knob having a cylindrical casing portion rotatably and axially movable within said body member and said actuating means and each ward member are disposed within said casing portion.

4. A lock as claimed in claim 1, wherein each said ward member protrudes axially from the end of the lock cylinder which is adjacent the handle, and said coupling actuating means comprises a plurality of push rods protruding beyond said end of the lock cylinder and movable axially relative thereto.

5. A lock as claimed in claim 1, wherein said key blade is provided with a plurality of said holes and each push rod is freely receivable within a respective hole, and has abutment means positioned thereon to engage said key blade after each push rod has entered a respective hole.

6. A lock as claimed in claim 5, wherein two push rods are provided arranged in substantially diametrically opposed relationship with respect to the axis of the lock cylinder.

7. A lock as claimed in claim 4, wherein said latch actuating member is axially movable and freely rotatable within said lock cylinder, and has an outer end portion adapted to move axially out of the end of the lock body remote from said handle into operative engagement with the latch release means when said key blade is operatively inserted.

8. A lock as claimed in claim 7, wherein a rod member is fixedly mounted in said lock cylinder and projects axially toward the inner end of said latch actuating member, and said coupling actuating means further comprises a bushing loosely mounted on said rod interposed between said latch actuating member and said push rods, so that said push rods are engageable with said bushing to transmit simultaneous actuating axial movement of the push rods to said latch actuating member and thereby engage said coupling means.

9. A lock as claimed in claim 8, wherein said bushing is adapted to tilt off center and jam on said rod member in response to relative axial movement of said push rods and thereby prevent engagement of said coupling means.

10. A lock as claimed in claim 4, wherein said lock cylinder comprises an inner cylinder and an outer cylinder enclosing said inner cylinder, said ward members protrude in the axial direction from said outer and inner cylinders toward said handle, said push rods are axially slidably mounted in and protrude from said inner cylinder toward said handle, and the free ends of said ward members and said push rods at the handle ends are in substantially the same plane in the locked position.

11. A lock as claimed in claim 10, wherein said inner cylinder and said outer cylinder are normally relatively non-rotatable.

12. A lock as claimed in claim 11, wherein said inner cylinder is eccentrically positioned relative to said outer cylinder.

13. A lock as claimed in claim 1, wherein said key blade comprises a frame member, at least one disc member rotatably mounted within said frame for rotation in the plane thereof, and a hole for each ward in said disc so that rotation of said disc relative to said frame alters the combination of said key.

14. A key as claimed in claim 13, wherein two disc members are provided comprising an outer disc and an inner disc rotatably mounted within said outer disc in the plane thereof, at least one further ward hole is provided in said inner disc, and at least one further ward is provided in position to be received in said further ward hole.

15. A lock as claimed in claim 14, wherein said inner disc is eccentrically mounted relative to said outer disc.

16. A lock as claimed in claim 1, wherein said handle is movable axially outwardly from a normal position relative to said lock body, said key opening is located to be accessible for insertion of said key blade only when said handle is pulled outwardly from said normal position, and said key blade cooperates with said coupling actuating means in said normal position of said handle to cause engagement of said coupling means so that subsequent rotation of said handle causes rotation of said latch actuating member.

17. A lock as claimed in claim 16 and further comprising a spring means operably engaging said handle and said body member resiliently urge said handle towards said normal position.

* * * * *